US006483016B1

(12) United States Patent
Thum

(10) Patent No.: US 6,483,016 B1
(45) Date of Patent: Nov. 19, 2002

(54) HAMMERED DULCIMER

(76) Inventor: Richard J. Thum, 36 Villawood La., St. Louis, MO (US) 63119

( * ) Notice: Subject to any disclaimer, the term of this patent is extended or adjusted under 35 U.S.C. 154(b) by 0 days.

(21) Appl. No.: 09/718,793

(22) Filed: Nov. 22, 2000

(51) Int. Cl.[7] ..... G10D 1/00
(52) U.S. Cl. ..... 84/284; 84/285; 84/293
(58) Field of Search ..... 84/284, 285, 293

(56) References Cited

U.S. PATENT DOCUMENTS

| | | | | | |
|---|---|---|---|---|---|
| 4,126,074 | A | * | 11/1978 | Lundquist | 84/313 |
| 4,388,852 | A | * | 6/1983 | Cramer | 84/284 |
| 4,506,584 | A | * | 3/1985 | Oakley | 84/293 |
| 5,445,058 | A | * | 8/1995 | Hoke, Jr. | 84/293 |

FOREIGN PATENT DOCUMENTS

| | | | |
|---|---|---|---|
| JP | 402029698 | * | 1/1990 |

* cited by examiner

*Primary Examiner*—Shih-Yung Hsieh

(57) ABSTRACT

A hammered dulcimer with a bridge having arrays of holes overlapping at the high tone strings, while providing a beam to an increasing extent as the tones deepen. The bridge is more flexible at the higher tones. The bridges, treble and bass, are supported by members beneath the top that include a metal rod having line contact with the top, and that include a wooden strip that is dished to receive the rod with surface contact. The braces have small pads secured to the top for a minor part of their extent. The braces and side rails at the string blocks are provided with cooperating wedge surfaces that convert the horizontal force vector of string tension into a downward vector exerted against the string block that will offset the upward vector of string tension on the string block; such upward force vector is also resisted by a screw at each corner of the frame that extends downwardly and inwardly through the string block into the front and rear braces. Color coding indicia on the string terminators assist in matching a string with a terminator. Tuners are provided at each end of the strings.

24 Claims, 3 Drawing Sheets

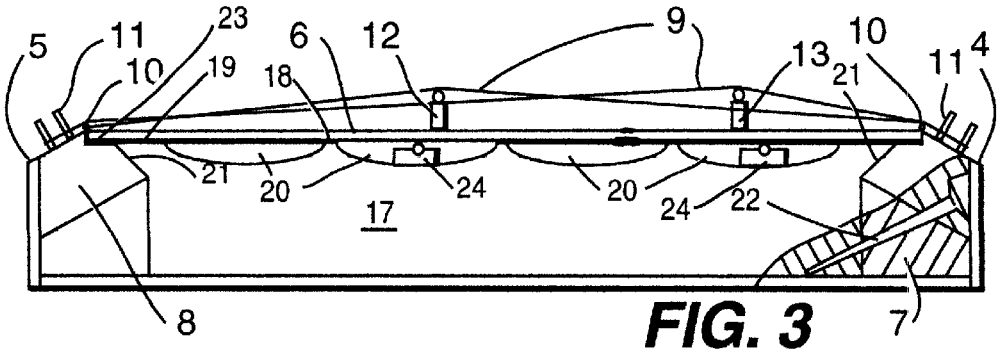
FIG. 3
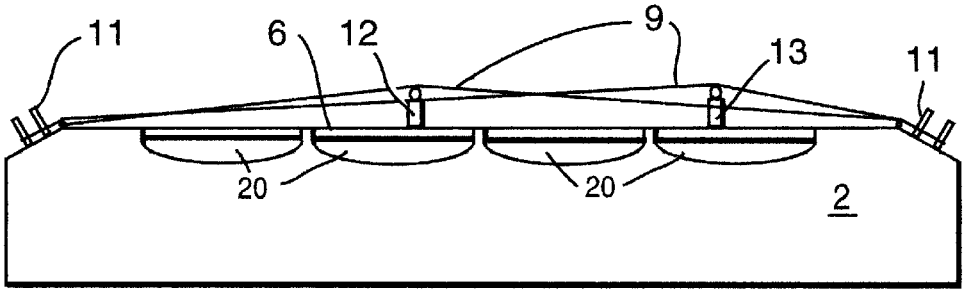
FIG. 11
FIG. 6
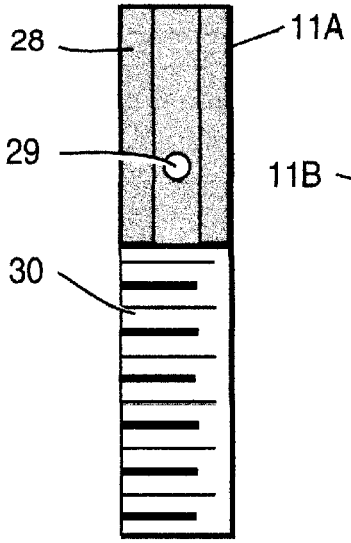
FIG. 7
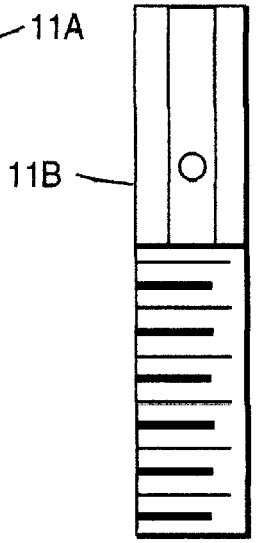
FIG. 12
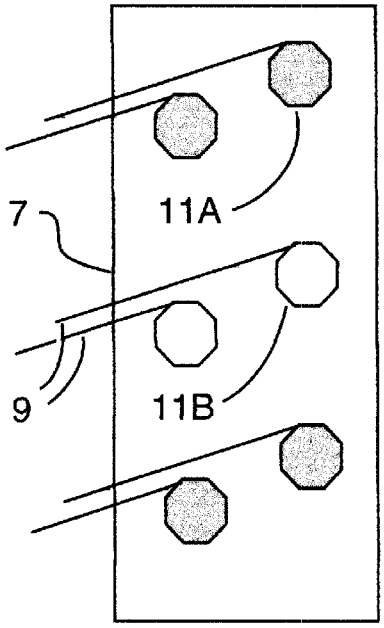

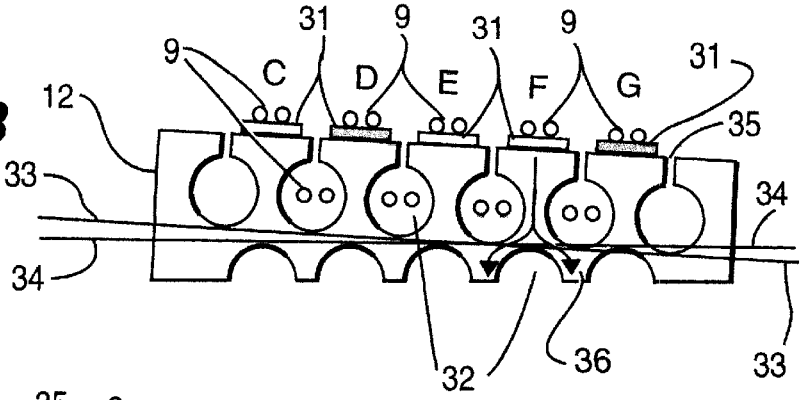
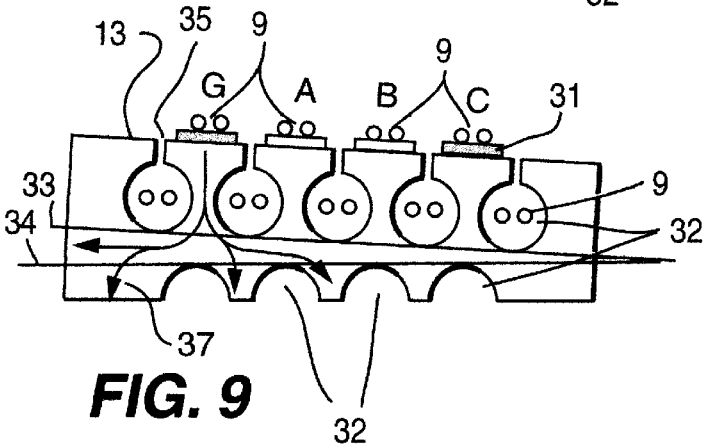
FIG. 9
FIG. 10
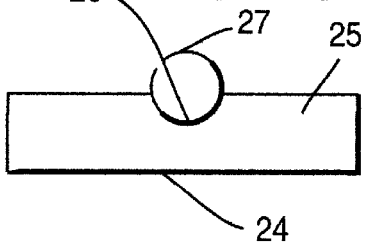
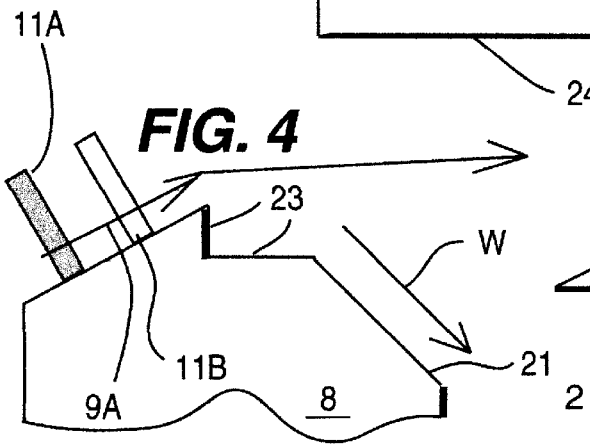
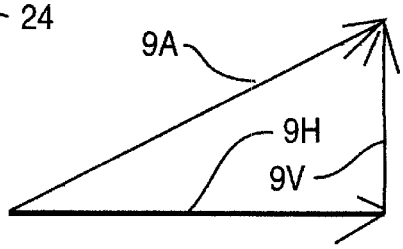
FIG. 5

HAMMERED DULCIMER

BACKGROUND OF THE INVENTION

Dulcimers may be of two types: (1) a fretted, mountain or lap dulcimer, or (2) a hammered dulcimer. When used herein the term dulcimer will refer only to the latter type, that is the hammered dulcimer.

A hammered dulcimer is a stringed instrument that is not fretted, that is there is a different string or string set for each tone that can be played with the instrument. The tones are played by striking the appropriate string set with a hammer, one hammer for each hand. Thus, a hammered dulcimer is a percussion instrument.

The case is usually trapezoidal for modern instruments, though instruments of many shapes have been made over the many thousands of years that the instrument has been in use.

Various factors may be used to evaluate a hammered dulcimer. Some of these are: aesthetic appearance, attack, dynamic range, intonation, playing qualities, sound quality or voice, stability, sustain or decay, tonal range, and weight. Individual players will rank these factors in different orders according to their personal hopes and artistic demands. There is no right or wrong or correct order to the list.

1) Aesthetic Appearance: Beauty should be judged on sound not upon dramatic visual appeal. It should be a beautiful listening experience.
2) Attack: This technical term refers to the initial onset of sound of any musical instrument. Too few hammered dulcimer players consider this aspect of an instrument. Players have limited control over how rapidly a sound is produced by an instrument. A tone may be struck hard and forced out of an instrument, but the controlling property of attack is in the hands of the designer and builder. The property of attack is intertwined with sustain. Great sustain often implies a muddy or slow attack. A weak sound is usually the result of a slow or mushy attack. The greater the attack, the greater expressive control a player has over an instrument. Some players refer to quality of attack in an instrument as punch, where once a player expresses a tone, the sound leaps out. This is a valuable quality in an instrument because it gives the player great control and expressive power. Without a clear attack, a player sounds tentative and muddy-undefined, inarticulate. It is important to note that high quality attack need not sacrifice sustain.
3) Dynamic Range: Wherever there are discussions of sound this technical term appears. Recording engineers often speak of this concept as head room. Most hammered dulcimers have poor dynamic range. On many instruments it is impossible to tell whether the hammer strike on a tone has been struck hard or soft. That means it is nearly impossible to distinguish between a soft tone and a loud tone on a hammered dulcimer. Dynamic range is exceedingly difficult to build into a percussive string instrument. Trumpets, drums and woodwinds respond when beaten or blown harder. Yet, traditional folk instruments such as guitars, mandolins, banjos, and dulcimers all have inherently limited dynamic ranges. This feature allows the player expressiveness. A passage may be soft without sacrificing either quality of attack or suffering a stunted playing style. Few, if any, dulcimers achieve this kind of artistic finesse.
4) Intonation: The technical term has to do with how accurately the scale can be played through the range of an instrument. Beginning violinists (and their families) suffer through learning various positions on the fingerboard in order to produce accurate tone. Trombonists have to learn where to position the slide in order to produce an accurate tone. All a hammered dulcimer player can do is strike the tone. Intonation is completely in the hands of the builder. If the design is wrong, the instrument will be sour somewhere in its range. Often the southwest quadrant of a hammered dulcimer, the key of A, is both nasal in its timbre and imperfect in its intonation. It is highly desired that the key of A is as sweet as the key of D or G. That is each key should be as expressive as every other key and have the same dynamics and full sound throughout the range in order for intonation to be dead-on precise, so that the scales work within themselves and in relationship to each other. Tunes that modulate do not thereby impose embarrassing and awkward sounds as a player moves from D to G to A, when there is no degradation in intonation and thereby no degradation in listening experience.
5) Playing Qualities: Hammered dulcimers can be loosely categorized as high or low-tension instruments. Low-tension instruments demand a very careful, delicate playing style. Often such instruments tax and enervate the player because of the extreme attention they require to generate an artistic sound. High-tension instruments tolerate a heavy playing style. The choice in instruments sometimes comes down to timid versus bold—that is to say ballad-style versus old-time-style. It is difficult to find an instrument that tolerates and expresses both playing styles. This design feature may eliminate a player's ability to produce soft, gentle but clear tones, or require the dulcimer to be nursed to produce the sound a tune demands.
6) Sound Quality or Voice: Sound quality is the most difficult attribute for a designer-builder team to achieve. Sound quality has to do with the overall effect of a dulcimer's sound throughout its range. This is entirely related to how effectively an instrument expresses the overtone series. The subtlety of this measure of an instrument is what separates a Stradivarius from just a violin. A quality sound is an amalgam of complex sound waves that produces an expressive, convincing, moving, and appealing timbre throughout the range of the instrument. Nothing could be tougher to accomplish for a builder and designer.
7) Stability: Temperature changes, humidity changes and jarring are severe on the tuning of a dulcimer. Stability of the instrument is its ability to resist going out of tune under such adverse conditions.
8) Sustain or Decay: The amount of sustain required in an instrument is determined by the type of music that will be played. Unlike the piano or wind instrument, a dulcimer has no means for controlling its sustain. Whatever the builder creates is what the player has to work with. If the instrument is to be used for nothing but fast fiddle tunes, the sustain should be minimal. It is not difficult to build an instrument with short sustain properties. If the instrument is to be used for nothing but slow, airy, chord-filled pieces, lingering sustain is important. Ballads, hymns, new age pieces often need extended sustain characteristics to make the presentation a success. Most people play a range of music requiring both styles. Balance of sustain and decay are satisfying to the listener and player by providing sufficient sustain to create character without so much sustain that the listening experience becomes a muddy, sonic garble.
9) Tonal range: This term refers to the number of octaves covered and whether the octaves are diatonic or chromatic, which is a function of the number of string sets of different tones and the overall size of a hammered dulcimer. This quality is not involved in the structural novelty of the present invention.

10) Ease of tuning: A typical 16/16 hammered dulcimer has sixteen string sets on the treble bridge and sixteen string sets on the bass bridge, with each set having two strings. Thus there are sixty-four strings to adjust and if one is not very careful one string will be sounded at the bridge and another adjusted at the string block, which can result in breakage. Also it is necessary to tune each side of the treble bridge separately, which adds another thirty-two tunings. According to ones tonal tolerance, the process may be repeated one or more times, as the tuning of one string may affect the others. Even this may not produce accuracy on either side of the bridge if the bridge is not true or is not properly placed. Further, friction at the bridge may result in uneven tension across the bridge. The manufacturer can help by improving the stability and improvement is also obtained by accurate placement of the bridge.

11) Durability or Strength: For a portable musical instrument, the hammered dulcimer is heavy, with a modern light instrument maybe weighing twenty-five pounds, and the stand adding extra weight. Manufacturers frequently sacrifice strength for weight saving and many such instruments develop warped tops and implode, in addition to loosing stability.

12) Weight: While lightness is desired, it is difficult to reduce weight without sacrificing others of the attributes listed here.

SUMMARY OF THE INVENTION

It is an object of the present invention to provide a hammered dulcimer with features to improve the factors of: aesthetic appearance, attack, dynamic range, intonation, playing qualities, sound quality or voice, stability, durability, ease of tuning, sustain or decay, and weight. By actual construction of test dulcimers with and without the features, improvement has been obtained by: novel connections of the string blocks to the braces and top, without increasing mass of the components; novel construction of the bridges that control the flexibility of the bridge in contacting and vibrating with the top; controlling the paths of the tones through the bridge differently according to the frequency of the tones; improving the action of the top through a composite bridge support of novel shape and materials; providing tuners at each end of the strings to improve tuning accuracy across the bridge; indicia on the string terminators to coordinate identification of a string at the terminator to correspond to a bridge position; providing a high percentage of elongated sound holes at the front and rear adjacent the top; and floating the top at such sound holes and for a major portion of the area immediately above the interior braces.

BRIEF DESCRIPTION OF THE DRAWING

Further features, advantages and objects of the present invention will become more clear from the following detailed description of a preferred embodiment, which is also the best mode known presently for carrying out the invention and which is shown in the accompanying drawing, wherein:

FIG. 3 is a front elevational view, of FIG. 1, with the front veneer removed and a lower right hand portion removed or in cross-section;

FIG. 4 is an enlarged portion of the pin block of FIG. 3, with pins, showing the forces on the pin block as produced by tensioning the strings;

FIG. 5 is a vector analysis of one of the forces that are shown in FIG. 4;

FIG. 6 is a side elevational view of one of some identical ones of the tuners;

FIG. 7 is a side elevational view of one of the other identical ones of the tuners;

FIG. 8 is a side elevational view of the treble bridge and the strings, of FIGS. 1 and 3;

FIG. 9 is a side elevational view of the bass bridge and the strings, FIGS. 1 and 3;

FIG. 10 is an enlarged end view of one of the bridge supports that re shown in FIGS. 2 and 3;

FIG. 11 is a front elevational view of the hammered dulcimer of FIG. 1, which is a mirror image of the rear elevational, except the rear view would have one less sound hole and show portions of the plain sides; and FIG. 12 is an enlarged plan view of a portion of one of the pin blocks with pins and strings.

DETAILED DESCRIPTION OF THE EMBODIMENT AND BEST MODE

Figure 1:
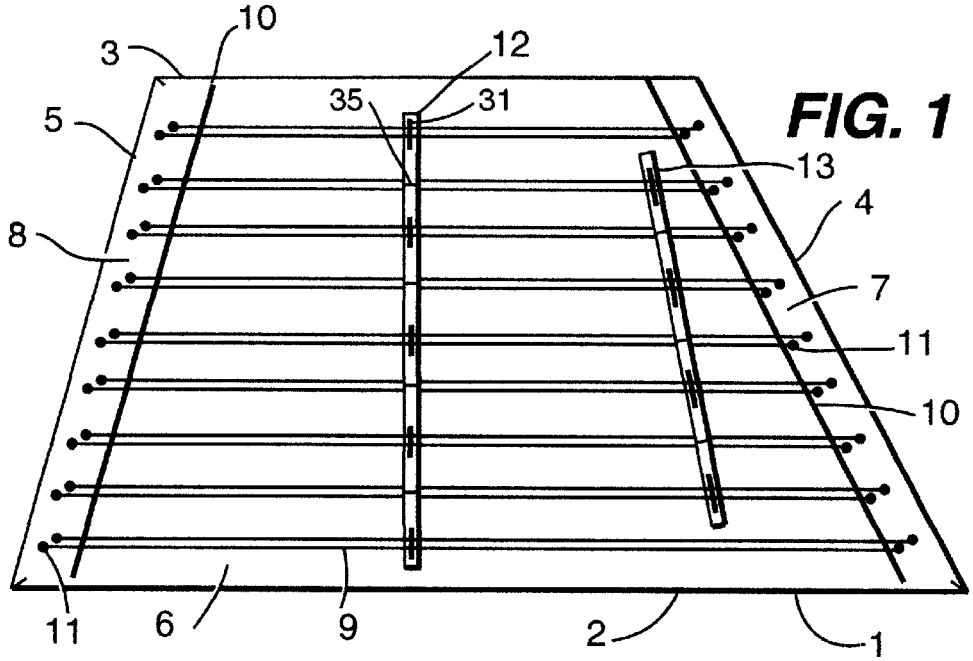
FIG. 1 is a plan view of the complete hammered dulcimer embodying the present invention.

In the description, like numerals refer to like parts in the various figures of the drawing.

As shown in FIG. 1, the hammered dulcimer 1 has a trapezoidal shape in plan or top view, with a front side wood veneer 2, a rear side wood veneer 3, a right side wood veneer 4, a left side wood veneer 5, and a planar sheet wood top 6, as orientated generally for playing. A bottom that is substantially the same as the top 6 is not shown. Glued to the right side veneer 4 and the left side veneer 5, are one piece or preferably laminated string blocks 7, 8, respectively, with at least the upper part of each string block 7, 8 being preferably a hardwood such as maple. Each string block has a plurality of string terminators ti, which hold and optionally adjust the respective terminal ends of individual strings 9.

In the conventional hammered dulcimer, the string terminators 11 are pins, with one end of each string 9 being held by a fixed pin and the other end being adjusted in tension by an adjustable, particularly rotatable, pin. Thus, such a string block 7 or 8 is usually called a pin block. For reasons later apparent, the present invention employs adjustable terminators 11 at each end of most or all of the strings 9. Adjustable terminators 11, preferably the rotatable pins shown, are tuners in that when rotated, they change the tension and thus the tone of the string 9 up or down in frequency depending upon the direction of rotation.

Each of the strings 9 is bent downwardly and outwardly over a string guide 10, at each end adjacent a corresponding terminator 11, one string guide 10 for each side of the dulcimer. These string guides 10 are, for example, a plastic or metal rod and are well known.

Between the terminators 11 is a bridge over which each string is bent, a treble bridge 12 for the treble bridge ones of the strings 9 and a bass bridge 13 for the remaining ones of the strings 9. The treble bridge ones of the strings 9 pass through the bass bridge 13 without touching it and the bass bridge others of the strings 9 pass through the treble bridge 12 without touching it, as shown in FIGS. 8 and 9, respectively. Although such is usually a diatonic dulcimer, some dulcimers are constructed this way to include other tones between the diatonic tones, i.e. to be chromatic. The present invention relates to either and also to a modification wherein additional bridges and strings are set up at other locations (not shown). The hammered dulcimer of the embodiment is a diatonic dulcimer.

The strings that pass over and contact with the treble bridge, i.e. the treble bridge ones of the strings 9, provide different playable tones on each side of the treble bridge, usually in the relationship of fifths to each other, e.g. a D on the right side of the treble bridge 12 would have an A on the left side of the treble bridge 12 for the same string 9 on a diatonic dulcimer. Other string arrangements, such as fourths may be used.

In a frictionless world, the string tension would be the same on both sides of a bridge 12, 13, for each string 9. However, friction between the string and bridge causes a difference in tension across a bridge, and such is tolerated to varying degrees according to the playing environment and the players personal tolerance for an off tone. Players will tune the string by sounding a tone at one side of the bridge 12, 13 and adjusting the string tension of that string at the pin block 7, 8 until the desired tone is obtained as accurately as they want; if the tone was exactly what it should be and the bridge/string interface had no friction and if the bridge were exactly placed, the tone on the other side of the bridge for the same string would also be exactly what it should be. Various techniques are used to deal with real life friction and small misplacement of the bridge, with varying degrees of success: both sides of a string are alternately tuned; the string is lifted off of the bridge in an attempt to even the tension across the bridge; and the bridge may be moved.

The present invention addresses this tuning accuracy problem by providing tuner type terminators 11 at each end of each string 9 of the treble bridge 12 and preferably also at each end of each string 9 of the bass bridge 13, which has its strings only sounded on one side. In this way the person tuning can compensate for a slightly misplaced bridge, and can compensate for the friction between the string 9 and the bridge 12, 13. As to misplacement of the bridge, this not only involves a bodily shift of the bridge from where it should be, but also a bridge that may be accurately placed with respect to some strings and inaccurately placed with respect to other strings. For examples of the latter, the bridge 12, 13 may be warped, the rod 31 contacting the string is misplaced or badly worn, or one of the rods 10 at the sides of the dulcimer is curved over its length. Not only will the present invention easily compensate for all of these problems, it will also greatly reduce the time and effort devoted to tuning forty to one hundred or more strings, one or more times for a playing session.

The tuners 11 are shown on an enlarged scale in FIGS. 6 and 7, wherein the tuners 11 are in groups, for example two groups, differing from each other by some indicia or visual difference; preferable the two groups of tuners 11 differ in color as shown, with tuner pins 11A of one group being gray while the tuner pins 11B of the other group are highly polished or stainless steel. This visual difference is of considerable advantage when tuning, which tuning should be done each time the instrument is played. The sets of tuners 11 may be arranged in different patterns, e.g. as shown in FIG. 12.

Each tuner 11A or 11B, is provided with a through lateral hole 29, through which the terminal end of the respective string is passed when an instrument is strung by the manufacturer or when a string is replaced. Then the pin 11 is rotated to wrap the string 9 around the pin 11 and take up the slack in the string 9, after which further rotation of the pin 11 in the same direction increases the tension and thus the frequency, i.e. raises the tone of the string 9. Each pin 11A and 11B has a tool engaging upper portion, preferably a hexagonal shape 28 to engage with a standard tuning wrench, not shown, to provide the leverage to rotate the pin. The pin blocks 7, 8 are drilled with parallel rows of holes, and either a pin 11A or 11B is driven into a corresponding hole tightly to approximately the depth of the threads 30. The number of rows of holes and pins on each pin block is usually determined by the number of strings in a set.

During tuning of a string, the wrench (not shown) is placed on the tunable, i. e. rotatable, pin 11, the corresponding string 9 is sounded and the tone is judged by ear or an electronic device, and the pin is rotated to increase or decrease the pitch or frequency of the tone.

A problem occasionally arises when by accident the wrench is on one string and another string is being sounded, which commonly results in a string being over tensioned to the point of breaking.

The tone that a string will produce is dependent upon many factors, such as: tension, length, diameter, mass and materials. Generally, a string 9 produces its best tone at a tension near its breaking point and for that reason the string composition and diameter vary over the instrument to ideally have each string near its breaking point when properly tensioned. The variation of string length, shorter strings for the higher notes, is the reason for the trapezoidal shape of the common dulcimer and the reason that the bass bridge is sounded on only one side (the bass strings are the longest). Bass strings may obtain their mass by a winding of wire around a small diameter inner wire that takes the tension and may thereby be near its breaking point. The way to avoid such string breakage during tuning is to be very careful, which slows down the tuning time and demands considerable attention.

A string 9 is sounded close to the bridge 12, 13 and identified at the bridge, because a string produces its best tone at about one inch from the bridge. The string is easily identified at the bridge, because: only half of the strings 9 cross over each bridge 12, 13 (as seen in FIGS. 1 and 3 about half the strings 9 cross the treble bridge 12 and pass freely through the bass bridge 13, while the other strings 9 cross over the bass bridge 13 and pass through the treble bridge 12); the strings are arranged in sets (each set of usually two strings has its strings very close together to be struck at one time to sound the same tone); and usually the bridge has a color code (for example as shown in FIG. 8, with the D scale, the rod 31 under the D string is one color, the rods 31 under E and F strings are another color. The G string has the same color rod 31 as the D string because it is the start of the G scale; of course the fifths of A, B, C, D-octave are on the other side of the treble bridge 12 from D, E, F, G.

However, at the side of the dulcimer, string 9 identification is not as easy as it is at the bridge 12, 13. Identification at the bridge is practiced each time a string 9 is tuned and each time a string is struck during playing, but string identification at the pin block 7, 8 is performed only during tuning. At the pin block 7, 8, one is looking at all of the strings 9 instead of one half of the strings 9 at the bridge 12, 13. One cannot look at the pin block and bridge simultaneously, and the strings are difficult to trace from one to the other. The difficulty in seeing the strings 9 is why many, if not most players will not look at the strings when playing, but rather look at the bridge.

The present invention greatly reduces this problem by providing indicia on or adjacent the tuners 11 to assist in correlating each tuner to its corresponding string 9 at the corresponding bridge 7 or 8. With reference to FIGS. 6 and 7, the indicia is preferably a plurality of colors, although a shape or size difference may also be used. The pins 11A are one color and may all be the tuners for the strings 9 of the treble bridge 12, while the pins 11B are another color and may all be the tuners for the strings 9 of the bass bridge 13.

Another feature of the present invention is the improvement of the strength of the dulcimer, without increasing its weight. When an average dulcimer has forty to more than twice that number of tensioned strings, across the top only, the forces and torque that the instrument must resist to prevent implosion, warping, etc. are considerable. If weight were not a problem, it would be easy to add stronger bracing and more bracing, for example, but the instrument is supposed to be portable.

FIG. 4 is an enlarged partial view of the pin block portion of the side rail 8 and two pins 11A and 11B used to analyze the forces and torque mentioned above, which analysis is part of the present invention. The structure and analysis for the side rail 7 would be merely a reflection of that with respect to side rail 8 of FIG. 4. The tension of the strings 9 produce an upward and inward force 9A on the pins 11, which forces of all the strings 9 are transferred to the pin block 8 as a horizontal force component or vector 9H and a vertical force component or vector 9V, which will also torque the pin block 8 in the clockwise direction. It is common for the pin block 8 to become unglued and lift up and/ or rotate counterclockwise, implode, and at the least warp or break the top 6. Also a weakness in the dulcimer construction in resisting these forces and torques can result in instability of the instrument, that is, an inability to hold a tuning.

Figure 2:
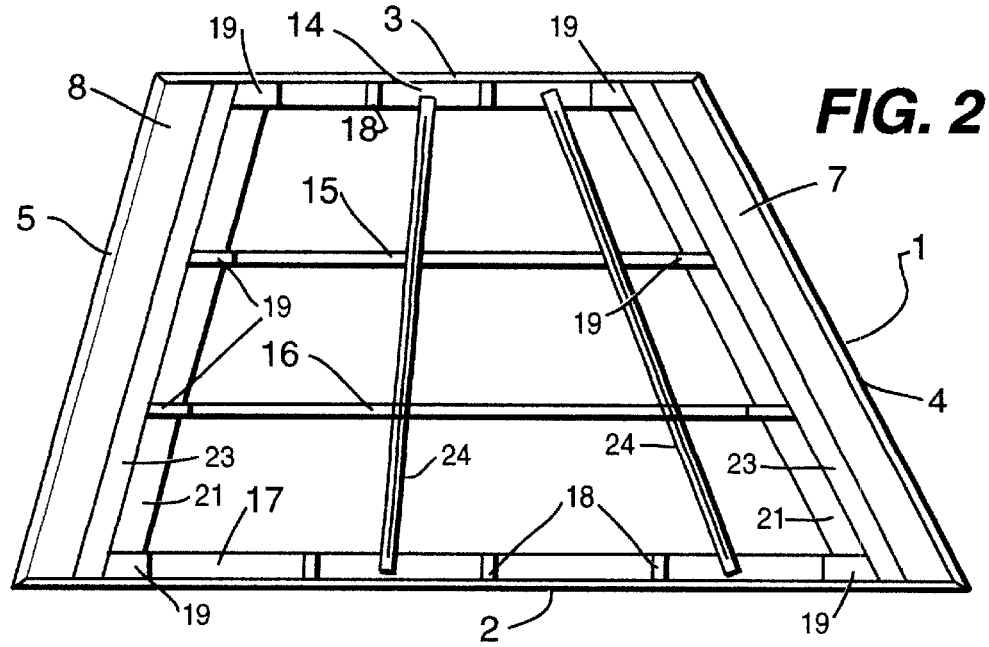
FIG. 2 is a top view thereof, with the bridges, strings, tuners and top removed.

The above problem is reduced or solved by the construction shown in FIGS. 3 and 4, in two different ways: 1) a screw 22 at each corner of the dulcimer, with only one being shown by way of representation in FIGS. 3, and 2) a wedge 21 between each brace 14–17 and each side rail 7, 8, with only the wedge between one brace 17 and the rails 7, 8 being shown as representative of all of them.

1) In FIG. 3, a wood screw 22 is shown as passing through a drilled and countersunk hole in the maple pin block 7, and then screwed into drilled holes in the lower lamination of the side rail and the lower portion of the cross brace 17. While glue is used between the laminations of the rail and between the rail and the brace, the screw resists stress upon the glue joints. Also the screw both holds down the pin block 7 and acts as a tension member at the lower portion of the instrument to offset the tensioned strings 9 that are tension members at the top portion of the instrument, that is the screw resists the torque analyzed above. The string torque on the left side of the instrument is clockwise as mentioned with respect to FIG. 4 and counterclockwise with respect to the right side where the screw 22 is shown in FIG. 3.

2) As shown in FIG. 3, the abutment of the side rails to the braces is not solely along a vertical plane as in conventional dulcimers, but includes an upwardly and outwardly angled interface that forms a wedge 21. As shown in FIG. 4, the horizontal component of force 9H forces the pin block 8 inwardly against the brace 17 to produce a downward and inward force W on the pin block 7 due to the wedge 21, which force W will have a vertical downward force vector that will offset the vertical upward vector 9V to a degree dependent upon the acute angle of the wedge, preferably to a substantial degree and most preferably to cancel the same.

Additional problems arise from the construction shown in FIGS. 1 and 2 that are common to conventional dulcimers, but the following analysis of the conventional portion of the structure is part of the invention as that of the inventor. As seen in FIGS. 3 and 11, the strings 9 cross over respective bridges 12, 13. Since the strings 9 are under tension, the strings 9 exert a downward force on the respective treble and bass bridges 12, 13. The top 6 engages and supports the bridges 12, 13. However, the top 6 is preferable a thin sheet of relatively soft and weak wood, such as spruce, to provide a good sound for the tones that are transmitted downwardly from the strings 9 through the bridges 12, 13 to the top 6, and therefore a top 6 that would be supported only at its edges could not adequately support the bridges and still be light enough in construction to produce a good sound. Therefore, the bridge supports 24 extend along and on the opposite of the top from the bridges 12, 13 to provide the needed support. The supports 24 are in turn supported by resting on an upper surface of each of the braces 14, 15, 16, 17.

In the present invention, each of the bridge supports 24 has a construction as shown in FIG. 10, with a uniform shape throughout its length. Wooden strip 25 is provided for strength and to transmit the sound downward to the braces and to the sound cavities between the braces 14–17. A channel 26 is provided for the length of the strip 25 and preferably conforms to the shape of a metal rod 27, to securely hold the rod 27 and to conduct sound efficiently between them. The metal rod is preferably round, but may be other shapes. The rod 27 has narrow, preferably line, contact with the top 6, which coupled with the hardness and smoothness of the rod 27 results in minimal friction and therefore lively action for the top 6 to vibrate with good responsiveness to the vibrations transmitted to the top from the bridges 12, 13. The inventor has recognized the quite different functions and different effects of the bridge support and has constructed the support of at least two vertically stacked materials directed respectively to the different functions and to desirably control the effects. The bridge supports 24 are not glued or otherwise secured to the top.

The action of the top 6 is further enhanced by supporting it at spaced locations along the front and back by top support pads 18 and 19 of the braces 14–17. These support pads 18, 19 are coplanar and provide for support of the top at a minor portion, preferably below 25%, of the braces 14–17. This provides for improved action of the top. Improved sound quality and volume are further provided by the front and back sound holes 20 (only the front ones being shown, because the rear sound holes are identical in shape and their number may be seen from FIG. 2). The top is glued along its side edges and side bottom portion to a channel 23 cut into each of the pin blocks 7, 8, and also to some or all of the support pads 18, 19.

The bridges 12, 13 of the present invention have novel constructions to improve the above mentioned factors of the instrument.

Higher tones are also higher in frequency, and therefore have shorter wavelengths. These shorter wavelengths generally are acoustically enhanced by structure that is of less mass and smaller dimensions, for example note the difference in size and mass of woofers for bass frequencies as compared to tweeters for the treble frequencies.

The bridges 12, 13 of FIGS. 1 and 3 are more clearly shown in FIGS. 8 and 9 on an enlarged scale. For conciseness of description: only five sets of strings 9 are shown for the treble bridge 12, which would produce tones C, D, E, F, G on the right of the bridge and, for example the fifths G, A, B, C, D- higher octave on the left of the treble bridge; and only four sets of strings are shown for the bass bridge 13, which would produce tones G, A, B, C on the left of the bass bridge and an octave lower than the correspondingly named notes on the treble bridge.

Therefore a five-four dulcimer is illustrated and for that reason the bridges 12, 13 are short looking. Most modern dulcimers are at least sixteen-fifteen dulcimers, which would extend the length of the bridges 12, 13 considerably.

In general, each of the bridges 12, 13 is constructed of a cross-section that decreases toward the higher notes, preferably uniformly decreases. In the embodiment, the bridges 12, 13 are of uniform width and decrease in height toward the higher notes. The bridges 12, 13 have an upper generally horizontal array of identical near circular apertures 32 and a lower horizontal array of equal radius arcuate apertures 32, with the upper array and lower array diverging at the same angle as the top and bottom surfaces of the bridges 12, 13. The slots 35 are conventional. The apertures 32 may be of different shapes.

A reference line 33 has been drawn tangent to the bottom of the upper array and a reference line 34 has been drawn tangent to the top of the lower array. The reference lines 33 and 34 converge toward the higher notes to intersect adjacent the higher notes within the confines of the treble bridge. In other words, the apertures vertically overlap at the high tone strings and are separated by a horizontal beam at the low tone strings. The result is that the bridges have decreasing mass and increased flexibility as the tones increase in frequency to improve sound transmission to the top.

As represented by the arrows 37 for the bass bridge of FIG. 9, the sound from the string propagates downwardly and splits due to an aligned lower aperture into two branches, with each branch then splitting further into two branches, one down and one horizontal, etc., with the amplitude diminishing with each split, that is decaying. The result for the bass notes is that the sound is spread out over a larger area of the top and the top/bridge adjacent the bass strings has a larger mass than adjacent the higher treble strings.

In contrast, the corresponding arrows 36 of the treble bridge 12 show that the vertically overlapping apertures of the upper and lower aperture arrays prevent more than one split to result in less spreading of the higher frequencies. The result for the treble notes is that the sound is spread out over a smaller area of the top and the top/bridge adjacent the treble strings has a smaller mass than adjacent the bass strings. This provides for a better sound according to the factors mentioned above.

The various features described in detail for the preferred embodiment and best mode have been tested and evolved from a considerable number of failures. These features of the preferred embodiment have been evaluated and have shown significantly improvement of the many different factors mentioned in the background, despite the fact that these instruments have been made for thousands of years on many continents.

While a preferred embodiment has been described in detail for the advantages of such details and to disclose a best mode with variations and modifications, further embodiments, modifications and variations are contemplated according to the broader aspects of the present invention, all as determined by the spirit and scope of the following claims.

What is claimed is:

1. A hammered dulcimer, to have strings hammered with a set of hammers when played to produce high, low and mid tones within a range, said hammered dulcimer comprising:

a two non-parallel side rails, each of said side rails having a portion constituting a string block;

a plurality of string terminators carried by each of said string blocks;

a front brace extending between and connected to the front of each of said side rails;

a rear brace extending between and connected to the rear of each of said side rails;

said rear brace and said front brace being parallel to each other, and together with said side rails forming a trapezoidal shaped frame;

a top connected to and covering the top of said frame;

a bottom connected to and covering the bottom of said frame;

a plurality of sets of strings, each of said strings having opposite terminal ends connected respectively to ones of said terminators of said string blocks, with said sets of strings being of different length for providing corresponding different tones when hammered;

a bridge loosely on said top and contactingly under said sets of strings; and at least a group of said sets of strings having each string extending continuously in only a single direction, from one of said terminators that is a string tension adjusting terminator at one of said two non-parallel side rails to said bridge, across said bridge, and from said bridge to another of said terminators that is a string tension adjusting terminator at the other of said two non-parallel side rails;

whereby said each string is tension adjustable for its length from one of said two non-parallel side rails to said bridge, and independently tension adjustable from said bridge to the other of said two non-parallel side rails, for independently fine tuning said each string on opposite sides of said bridge.

2. The hammered dulcimer of claim 1, wherein all of said terminators are string tension adjusting terminators.

3. The hammered dulcimer of claim 2, wherein said terminators are divided into groupings that have at least two different indicia, respectively, to visually distinguish said strings from each other at one of said string blocks for facilitating coordinating an individual string to at least one of its terminators during tuning and lessen the likelihood of breaking a string due to inaccurate tone or string vs. terminator pairing.

4. A hammered dulcimer, to have strings hammered with a set of hammers when played to produce high, low and mid tones within a range, said hammered dulcimer comprising:

two non-parallel side rails, each of said side rails having a portion constituting a string block;

a plurality of string terminators carried by each of said string blocks;

a front brace extending between and connected to the front of each of said side rails;

a rear brace extending between and connected to the rear of each of said side rails;

said rear brace and said front brace being parallel to each other, and together with said side rails forming a trapezoidal shaped frame;

a top connected to and covering the top of said frame;

a bottom connected to and covering the bottom of said frame;

a plurality of sets of strings, each string of said sets of strings having opposite terminal ends connected respectively to ones of said terminators of said string blocks, with said set of strings being of different length for providing corresponding different tones when hammered;

a bridge;

said bridge comprising at least a treble bridge loosely on said top and contactingly under a group of said sets of strings that include at least some of the high tones;

a plurality of holes extending transversely through said treble bridge in plural horizontal arrays that substantially meet or overlap in the vertical direction adjacent high tone ones of said strings;

a through discontinuity at the upper edge of said treble bridge between each of said sets of strings of said group into an adjacent one of the holes of the topmost of said arrays; and the holes of the bottom one of said arrays opening downward to said top with a discontinuity to thereby substantially eliminate a continuous horizontal beam to prevent straight horizontal conduction of sound along the length of said treble bridge at least adjacent ones of said strings with the high tones.

5. The hammered dulcimer of claim 4, wherein said treble and bass bridges are tapered upwardly to increase in height from one end adjacent high tone ones of said strings toward the opposite end.

6. The hammered dulcimer of claim 5, further including:

a bass bridge loosely on said top and contactingly under at least a group of others of said sets of strings that include at least some of the low tones; and said bass bridge having said arrays vertically spaced from each other adjacent the low tone strings to thereby provide a continuous horizontal beam of wood to provide a straight horizontal transmission of sound along the length of said bass bridge at least adjacent ones of said strings with the low tones to spread out conduction of low tones horizontally to the top to a greater degree than the high tones.

7. The hammered dulcimer of claim 6, wherein the holes in each of said arrays are substantially the same size and shape.

8. The hammered dulcimer of claim 6, wherein the holes of said arrays are offset horizontally evenly from each other.

9. The hammered dulcimer of claim 5, wherein the holes of said arrays are offset horizontally evenly from each other.

10. The hammered dulcimer of claim 6, wherein said treble bridge for each of said sets at the high tones provides an inverted Y shape for direct sound conduction from the adjacent one of said string sets down a stem of the inverted Y and evenly splitting through two legs of the inverted Y to said top; and said bass bridge at the low tones provides a downwardly extending stem directly conducting the sound of the adjacent string set downwardly and then along the horizontal beam to split off and go down plural legs to said top in each direction of length of said bass bridge in diminishing intensity.

11. A hammered dulcimer, to have strings hammered with a set of hammers when played to produce high, low and mid tones within a range, said hammered dulcimer comprising:

two non-parallel side rails, each of said side rails having a portion constituting a string block;

a plurality of string terminators carried by each of said string blocks;

a front brace extending between and connected to the front of each of said side rails;

a rear brace extending between and connected to the rear of each of said side rails;

said rear brace and said front brace being parallel to each other, and together with said side rails forming a trapezoidal shaped frame;

a top connected to and covering said frame;

a bottom connected to and covering said frame;

a plurality of sets of strings, each string of said sets of strings having opposite terminal ends connected respectively to ones of said terminators of said string blocks, with said set of strings being of different length for providing corresponding different tones when hammered;

a bridge loosely on said top and contactingly under said sets of strings;

a bridge support extending transversely above said braces and generally beneath said bridge, and said top being between said bridge and said bridge support; and said bridge support having a rod in substantially line contact with an undersurface of said top and surface contact with a remainder of said bridge support.

12. The hammered dulcimer of claim 11, wherein said rod is metallic.

13. The hammered dulcimer of claim 12, wherein said remainder of said bridge support is nonmetallic.

14. The hammered dulcimer of claim 13, wherein said remainder of said bridge support has an upper channel receiving said rod with surface contact, and said remainder of said bridge support has surface contact with said braces, to provide line metal contact that keeps the top active and full surface contact to conduct sound to said braces and radiate sound downwardly to said back from said lowermost member.

15. The hammered dulcimer of claim 12, wherein the top one of said members is a brass rod and the bottom one of said members is a hardwood strip.

16. A hammered dulcimer, to have strings hammered with a set of hammers when played to produce high, low and mid tones within a range, said hammered dulcimer comprising:

two non-parallel side rails, each of said side rails having a portion constituting a string block;

a plurality of string terminators carried by each of said string blocks;

a front brace extending between and connected to the front of each of said side rails;

a rear brace extending between and connected to the rear of each of said side rails;

said rear brace and said front brace being parallel to each other, and together with said side rails forming a trapezoidal shaped frame;

a top connected to and covering the top of said frame;

a bottom connected to and covering the bottom of said frame;

a plurality of sets of strings, each string having opposite terminal ends connected respectively to ones of said terminators of said string blocks, with said set of strings being of different length for providing corresponding different tones when hammered;

a bridge loosely on said top and contactingly under said sets of strings;

said strings extending along a path such that tension in said strings exerts an inward force on said string blocks, which inward force has a vertical upward force vector and a horizontal inward force vector; and a screw extending downwardly and inwardly through each of said string blocks and into an adjacent one of said braces to counteract the vertical upward force vector at each of four corners of said frame, and thereby lessening likelihood of implosion of the dulcimer.

17. A hammered dulcimer, to have strings hammered with a set of hammers when played to produce high, low and mid tones within a range, said hammered dulcimer comprising:

two non-parallel side rails, each of said side rails having a portion constituting a string block;

a plurality of string terminators carried by each of said string blocks;

a front brace extending between and connected to the front of each of said side rails;

a rear brace extending between and connected to the rear of each of said side rails;

said rear brace and said front brace being parallel to each other, and together with said side rails forming a trapezoidal shaped frame;

a top connected to and covering the top of said frame;

a bottom connected to and covering the bottom of said frame;

a plurality of sets of strings, each string having opposite terminal ends connected respectively to ones of said terminators of said string blocks, with said sets of strings being of different length for providing corresponding different tones when hammered;

a bridge loosely on said top and contactingly under said sets of strings;

said strings extending along a path such that tension in said strings exerts an inward force on each of said pin blocks that has a vertical upward force vector and a horizontal inward force vector; and wedges comprising an outwardly facing surface of each end of said braces and extending downwardly and inwardly, and a corresponding mating inwardly facing surface on each of said string blocks to counteract the vertical upward force vector by converting some of the horizontal inward force vector into a downward force on said string block, and thereby lessening likelihood of implosion of the dulcimer.

18. The hammered dulcimer of claim 17, wherein said top extends outward into horizontal abutment with and horizontally overlapping each of said string blocks, so that the upper surface of said top is coplanar with the uppermost portion of said string block to counteract torque produced by the vertical upward force vector, and thereby lessening likelihood of implosion of the dulcimer.

19. The hammered dulcimer of claim 17, further including a screw extending downwardly and inwardly through each of said string blocks and into an adjacent one of said braces to counteract the vertical upward force vector at each of four corners of said frame, and thereby lessening likelihood of implosion of the dulcimer.

20. The hammered dulcimer of claim 17, further including at least one interior brace extending between and connected to corresponding mid-portions of said side rails; and wedges comprising an outwardly facing surface of each end of each said interior brace and extending downwardly and inwardly, and a corresponding mating inwardly facing surface on each of said string blocks to counteract the vertical upward force vector by converting some of the horizontal inward force vector into a downward force on said string block, and thereby lessening likelihood of implosion of the dulcimer; and each of said wedges being adjacent said top.

21. A hammered dulcimer, to have strings hammered with a set of hammers when played to produce high, low and mid tones within a range, said hammered dulcimer comprising:

two non-parallel side rails, each of said side rails having a portion constituting a string block;

a plurality of string terminators carried by each of said string blocks;

a front brace extending between and connected to the front of each of said side rails;

a rear brace extending between and connected to the rear of each of said side rails;

said rear brace and said front brace being parallel to each other, and together with said side rails forming a trapezoidal shaped frame;

a top connected to and covering the top of said frame;

a bottom connected to and covering the bottom of said frame;

a plurality of sets of strings, each string having opposite terminal ends connected respectively to ones of corresponding sets of said terminators of said string blocks, with said sets of strings being of different length for providing corresponding different tones when hammered;

a bridge;

said bridge comprising a treble bridge loosely on said top and contactingly under a first group of said sets of strings that include at least some of the high tones, and a bass bridge loosely on said top and contactingly under at least a second group of others of said sets of strings that include at least some of the low tones;

at least one of said terminators for each string being an adjustable tuner; and said terminators being divided into groupings that have at least two different indicia, respectively, to visually distinguish said strings from each other at one of said string blocks for facilitating coordinating an individual string to at least one of its terminators during tuning and lessen the likelihood of breaking a string due to inaccurate tone or string vs. terminator pairing.

22. The hammered dulcimer of claim 21, wherein each of said terminators has adjustable tuning.

23. The hammered dulcimer of claim 22, wherein said different indicia are different colors.

24. A hammered dulcimer, to have strings hammered with a set of hammers when played to produce high, low and mid tones within a range, said hammered dulcimer comprising:

two non-parallel side rails, each of said side rails having a portion constituting a string block;

a plurality of string terminators carried by each of said string blocks;

a front brace extending between and connected to the front of each of said side rails;

a rear brace extending between and connected to the rear of each of said side rails;

said rear brace and said front brace being parallel to each other, and together with said side rails forming a trapezoidal shaped frame;

at least one interior brace extending between and connected to corresponding mid-portions of said side rails;

a top connected to and covering the top of said frame;

a bottom connected to and covering the bottom of said frame;

a plurality of sets of strings, each string having opposite terminal ends connected respectively to ones of said terminators of said string blocks, with said sets of strings being of different length for providing corresponding different tones when hammered;

a bridge loosely on said top and contactingly under said sets of strings; and said braces each having a plurality of horizontal surface pads engaging and adhering to said top at spaced locations providing less than ten percent contact between the top of said braces and said top along the length of the braces.

* * * * *